US005182972A

United States Patent [19]

Skaleski

[11] Patent Number: 5,182,972

[45] Date of Patent: Feb. 2, 1993

[54] IMPROVED FINGER TIP MOUNTED HOLDING DEVICE

[76] Inventor: Robert A. Skaleski, 18 Lakeview Dr., Ridgefield, Conn. 06877

[21] Appl. No.: 618,990

[22] Filed: Mar. 28, 1991

[51] Int. Cl.[5] ..... B25C 3/00

[52] U.S. Cl. ..... 81/44; 81/13; 81/177.3

[58] Field of Search ..... 81/13, 44, 177.3

[56] References Cited

U.S. PATENT DOCUMENTS 413,579 10/1889 Stewart ..... 81/177.3 X
1,000,226 2/1911 Arwine ..... 81/177.3 X
2,348,962 5/1944 Davis .
2,420,869 5/1947 Davis .
2,735,321 2/1956 Browne et al. ..... 81/13
3,729,035 4/1973 Manzanarez .
3,913,646 10/1975 Grayson .
4,256,157 3/1981 Grayson .

*Primary Examiner*—James G. Smith
*Attorney, Agent, or Firm*—CTC & Associates, Inc.

[57] ABSTRACT

An improved finger mountable holding device to temporarily hold an object in a tight space on a finger while an operation is performed utilizing the object, the device includes a tubular elastomeric body with a wall, a finger entering first open end an axis, a hole through the wall, a plurality of slits radiating outwardly from the hole to form flaps extending circumferentially around the hole. The flaps are capable of elastically flexing to dilate the hole whereby the object will pass therethrough to subject the flaps to elastic flexure to dilate the hole and to elastically hold the object in predetermined position in which the operation can be performed.

5 Claims, 5 Drawing Sheets

IMPROVED FINGER TIP MOUNTED HOLDING DEVICE

BACKGROUND OF THE INVENTION

This invention relates to improved holding devices which is mounted on a finger for temporarily holding an object in a tight space while an operation is performed on or with the object. The invention also relates to a combination including the holding device, mounted on a finger and an object temporarily held in engagement by the holding device.

It is known that difficulty is often experienced in manipulating small objects, such as nuts and bolts, in tight or cramped quarters in which it is difficult or next to impossible to use one's hand to position the objects while operations are performed thereon. Such operations commonly include but are not limited to turning nuts and bolts into threaded engagement with mating parts.

The following prior U.S. Patents may be of interest as background, but they are not seen as pertinent to the present invention, either as to structure or manner of operation.

| U.S. Pat. No. | Date | Inventor |
|---|---|---|
| 2,348,962 | May 16, 1944 | Davis |
| 2,420,869 | May 20, 1947 | Davis |
| 3,729,035 | April 24, 1973 | Manzanarez |
| 3,913,646 | October 21, 1975 | Grayson |
| 4,256,157 | March 17, 1981 | Grayson |

Davis '962 discloses a metal nail or tack holder in the form of a thimble containing springs, etc. and having a flattened surface. It is not for holding the nail or tack in an inaccessible location, but rather protects a finger against being struck with a hammer or the like.

Davis '869 provides a combination metal finger protector and nail holder wherein the nail holder is rotatably mounted with respect to the protector for positioning the nail preparatory to driving with a hammer.

Manzanarez teaches a metal apparatus engageable with a thumb and having a spring loaded extension for detachably holding a nail in driving position such that the user's fingers cannot be struck with a hammer.

Grayson '646 is a metal bolt holding tool with thimble-like support member on which at least one holding device is mounted. Magnets and wire clips permit accomplishment of a wide range of nut and bolt holding tasks.

Grayson '157 is a metal nut, bolt and screw holder arrangeable on the finger of a user. The entire finger is used for support, and the entire finger may be used to position a holding portion of the holder.

OBJECT OF THE INVENTION

An important object of the present invention is to provide a simple, low cost holding device for temporarily holding an object on a finger for work in a tight location or in a location that is inaccessible to one's hand.

Another important object of the invention is to provide such a holding device that is reliable to use.

A further important object of the invention is to provide such a holding device that is reusable an indefinitely large number of times.

An additional important object of the invention is to provide such a holding device that is substantially self-adjusting to fit fingers of various sizes.

A still further important object of the invention is to provide such a holding device that is so constructed that a plurality of such devices can conveniently have identical objects temporarily held thereby, with such devices ready to receive a finger or other elongated member to facilitate the performance of repetitive operations.

Yet another important object of the invention is to provide such a holding device that can be used in rapid succession many times without any substantial discomfort to the user.

The foregoing and additional objects and advantages of the invention will become apparent hereinafter.

SUMMARY OF THE INVENTION

The invention presents a holding device for temporarily holding an object in a tight space mounted on a finger while an operation is performed on or with the object. The device includes a body of transparent elastomeric material, the body being of generally tubular form with a wall, a finger entering first open end, an axis, a hole through the wall, and a plurality of slits radiating outwardly from the hole to form flaps circumferentially between adjacent ones of the slits. The flaps are capable of elastic flexure to dilate the hole from its normal unstressed size to a larger size, so that the finger can be inserted into the open end and at least a portion of the object placed in the body between the finger and the hole whereby the object will subject the flaps to elastic elastically hold the object in predetermined position in which the operation can be performed.

Because of the flexible, elastomeric material of which the device is made, it can be used in rapid succession many times without any substantial discomfort to the user, unlike metal prior art devices.

A first combination embodying the invention includes a holding device as just described, mounted on a finger so that the inner surface of the fingertip confronting the hole, and an object having at least a portion within the body aligned with the hole and engaging the finger and releasably so held by the flaps which are elastically flexed by the object away from the finger. A second combination embodying the invention includes such a holding device releasably adhered to a hand and an object assembled with the holding device, ready to receive a finger for use in performing an operation on or with the object.

DESCRIPTION OF THE INVENTION

Figure 1:
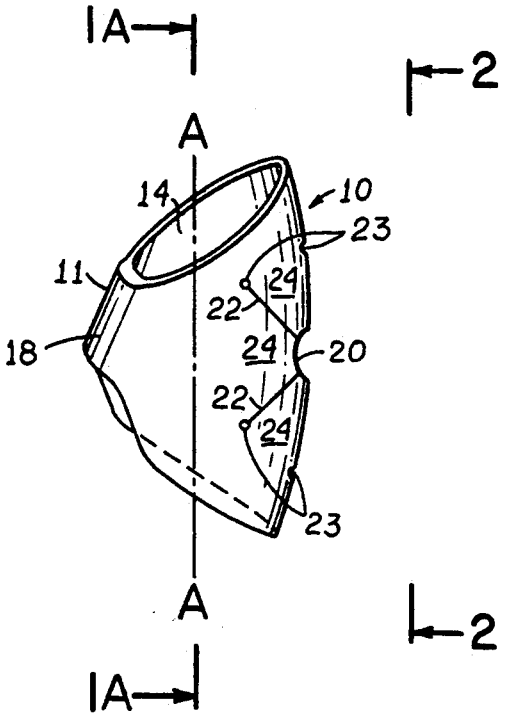
FIG. 1 is a side elevation, slightly in perspective, of a holding device that is a preferred embodiment of the invention.

The drawing shows a holding device 10 that is a preferred embodiment of the invention. Device 10 includes a body 11 of flexible, elastomeric material, preferably transparent, and is of one piece construction and is of generally tubular form, having a wall, a first or finger entering open end 12 and a second end 14 spaced from and generally aligned with end 12. As shown, but not necessarily, end 14 is a second open end so that the tip of a finger, such as an index finger 26 (FIGS. 3 and 4), can pass therethrough.

The preferred transparent nature of the flexible, elastic resilient material aids in manipulating device 10 as will become apparent.

The term "flexible, elastomeric material" as used herein shall have the meaning set forth in part 28 of ANNUAL BOOK OF ASTM STANDARDS, Titled: RUBBER, CARBON BLACK GASKETS of the American Society for Testing and Materials, D1566, namely "macromolecular material that returns rapidly to approximately the initial dimensions and shape after substantial deformation by a weak stress and the release of the stress". Such materials may be compounded cured elastomers as such as but not limited to natural rubber, polychloroprine, polyisoprene, silicone polyurethanes, polyacrylates, polybutadienes, styrenebutadienes, ethylene/propylene co and terpolymers and acrylonitrile rubbers or thermoplastic elastomers and/or elastoplastics such as SBS-styrenebutadiene or SIS-styreneisoprene block copolymers, polyether/polyester copolymers, polyurethane polymers, acrylic modified polyvinylchloride, compounded polyvinylchloride and the like. Typical physical characteristics of such elastomers useful in the instant invention are:

| Test Procedure | ASTM Number | Values |
|---|---|---|
| Resistance to indentation | D 2240 | 40-55 A |
| Tensile Strength | D 412 | 1000-3500 PSI (.067-2.25 $10^2$ Kg/Cm$^2$) |
| Elongation at Break | D 412 | 200-500% |
| Tear Strength (Die C) | D 624 | 100-350 lbs/inch (20-85 Kg/Cm) |
| Resilience (yersley) | D 945 | 30-70% |

The word "axis" as used hereinafter is not used with geometric precision, but is used as a general term only.

The wall of device 10 defines an axis A—A (FIG. 1) and ends 12 and 14 lie in planes that are not perpendicular to axis A—A but instead are angularly related thereto such that on one side 16 of axis A—A the wall of device 10 is relatively long in the axial direction and on an opposite side 18 of axis A—A the wall of device 10 is relatively short in the axial direction. Furthermore, the opening provided by end 12 is somewhat larger than that provided by end 14, by virtue of the fact that side 18 is closer to axis A—A at its axial end at end 14 than it is at its axial end at end 12.

Figure 2:
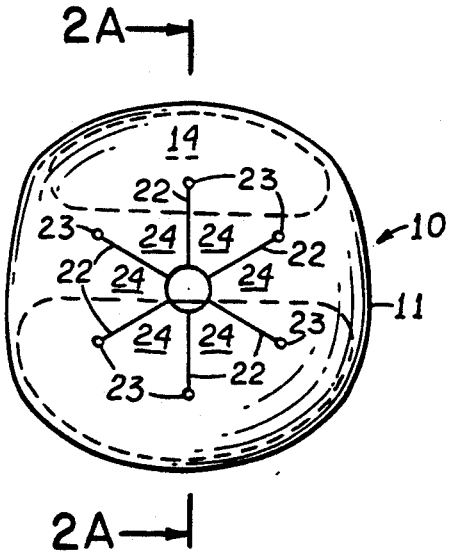
FIG. 2 is a view on line 2—2 of FIG. 1.

Long side 16 of the wall of device 10 has therethrough, at substantially its longitudinal midpoint, a circular hole 20, the center of which is on a line perpendicular to axis A—A. Radiating outwardly form hole 20 are a plurality of radial slits 22. Slits 22 are evenly spaced circumferentially and are all of the same length. To prevent tearing, the outer ends of slits 22 terminate in small diameter holes 23 in known fashion. As shown in FIG. 2, there are six slits 22 adjacent pairs of which are spaced 60 degrees apart. Thus, slits 22 form flaps or petals 24 circumferentially between adjacent slits 22, adjacent flaps 24 being capable of elastic flexure to dilate hole 20 from its normal unstressed size to a larger size.

Slits 22 may be greater or smaller in number than six, but there are preferably at least three slits 22, and still more preferably there are six slits 22.

A particularly preferred flexible, elastomeric material for device 10 is silicone rubber.

Figure 1A:
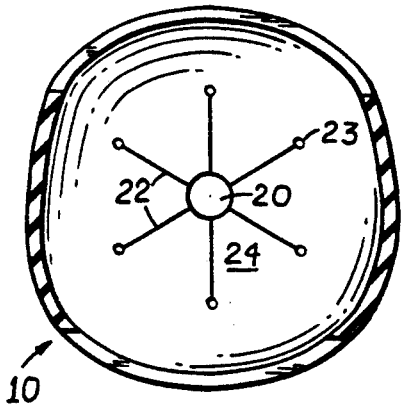
FIG. 1A is a view on line 1A—1A of FIG. 1.
Figure 2A:
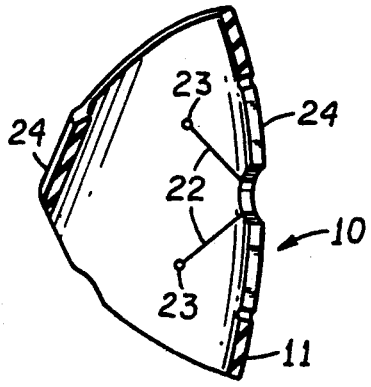
FIG. 2A is a view on line 2A—2A of FIG. 2.

FIGS. 1A and 2A are cross sections of device 10 at A—A as shown in FIG. 1 and FIG. 1A is a sectional view taken substantially on line 1A—1A of FIG. 1 and FIG. 2A is a sectional view taken substantially on line 2A—2A of FIG. 2, sections of device 10 at A—A as shown illustrating that the wall of device 10 is approximately 0.050–0.100 inch (1.25–2.5 mm) in thickness. It is noted that line 1A—1A substantially coincides with axis A—A.

Figure 3:
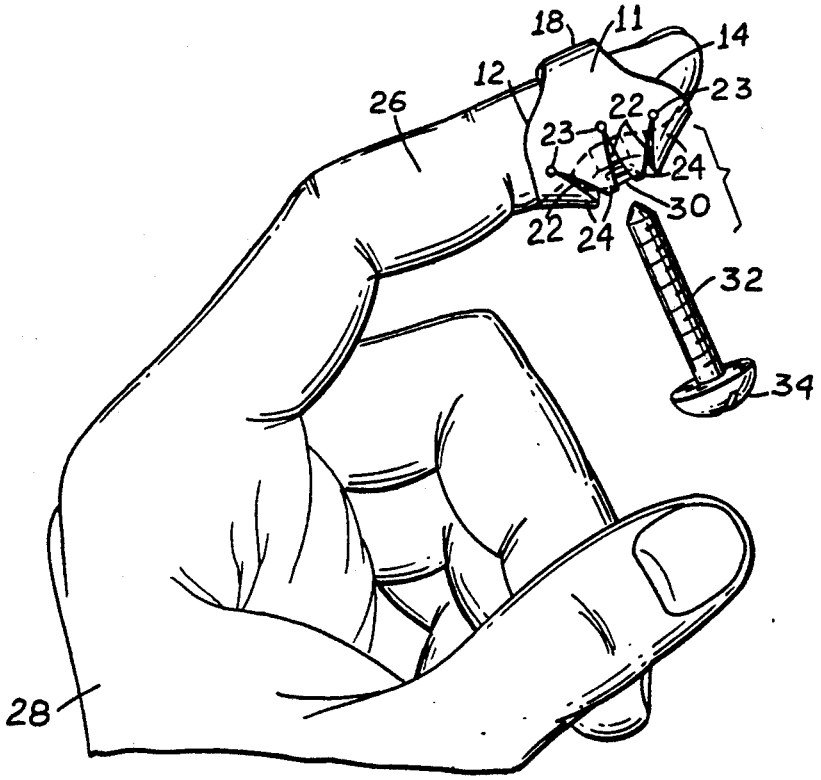
FIG. 3 is a view showing an elongated member in the form of an extended index finger, the holding device on the finger and holding a nut positioned to receive a bolt in threaded engagement therewith.
Figure 4:
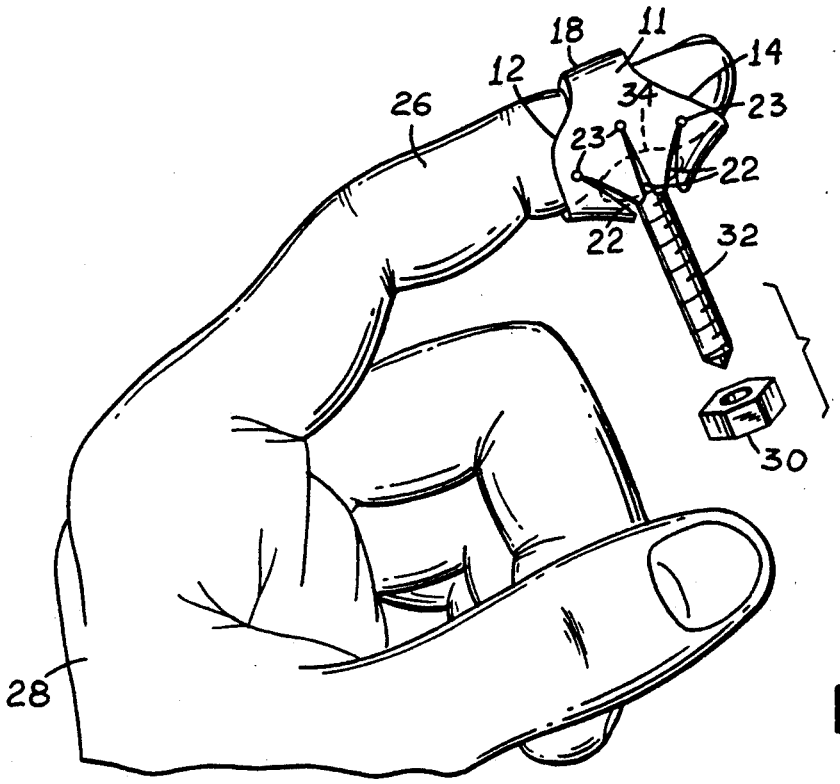
FIG. 4 is a view showing an elongated member in the form of an extended index finger, the holding device on the finger and holding a bolt head with a threaded shank protruding from the device and positioned to receive a nut in threaded engagement therewith.

FIGS. 3 and 4 illustrate the use of device 10 as an aid in performing holding maneuvers in spaces that are too small to permit the use of a hand.

In FIG. 3, an extended index finger 26 of a hand 28 has entered device 10, end 12 first, with hole 20 confronting and in registry with the inner surface of the fingertip of finger 26. A nut 30 is shown as having been inserted into device 10 between long side 16 of the body of device 10 and the inner surface of the fingertip of finger 26. Nut 30 has a threaded bore that is aligned with hole 20 and nut 30 flexes flaps 24 away from finger 26, whereby nut 30 is elastically held in place with respect to finger 26 which can then be manipulated into tight quarters where the bore of nut 30 can be positioned for threaded engagement with a bolt 32. When such threaded engagement is established, finger 26 with device 10 thereon can be removed from nut 30 and the threaded connection can be completed.

Bolt 32 has a head 34 that is shown in FIG. 4 engaging finger 26 and device 10 in the same fashion in which nut 30 engages finger 26 and device 10 in FIG. 3. In FIG. 4 the shank of bolt 32 protruded outwardly through hole 20 to be positionable while held by finger 26 for threaded engagement with nut 30. Once such threaded engagement is started, finger 26 with device 10 thereon can be removed from bolt 32 and the threaded connection can be completed.

Device 10 can be reused an indefinitely large number of times.

Device 5 illustrates the releasable mounting of the holding devices of the instant invention held in readiness on a hand. Releasable mounting is accomplished with the use of the well known two component hook and look system. Each of the components having a pressure sensitive adhesive backing. One of the components is releasably secured to the back of the hand and the second component is releasably secured to the holding device with the pressure sensitive adhesive backing thus placing the hook and loop components in position to cooperate to releasably hold the holding devices in position on the back of a hand. In this instance one element 12 of which is removably adhered on the exterior of device 11 opposite hold 20 and the other element 44 of which is removably adhered on hand 40. Elements 44 are shown adhered on the hook and look system adhered to back of hand 40, each element 44 being shown in FIG. 5 releasably engaging element 42 of one device 10', with each device 10' holding one bolt 32 with its head 34 within device 10' and its shank protruding through hole 20 in previously described fashion.

Figure 5:
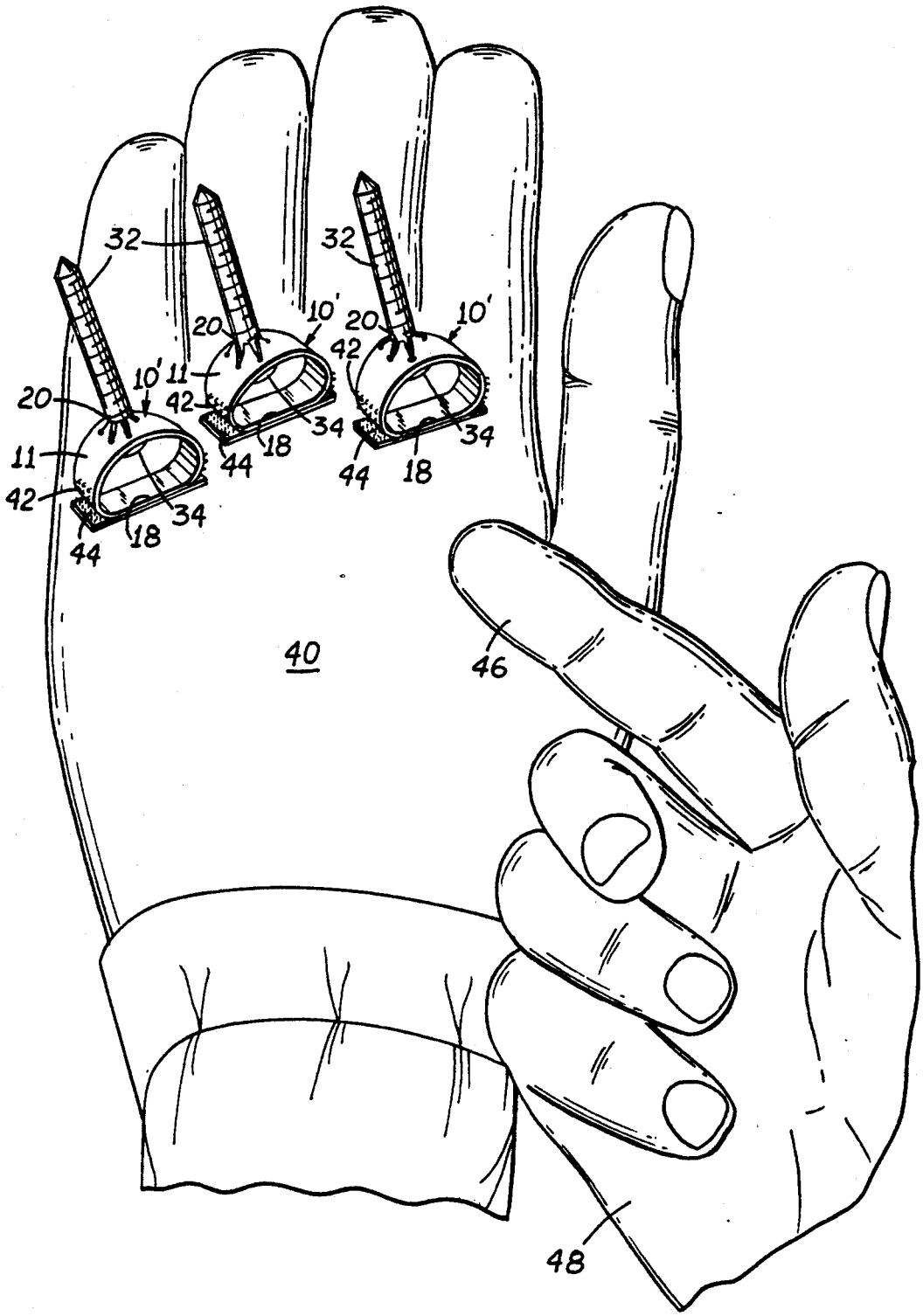
FIG. 5 is a view showing a plurality of inventive holding devices each releasably holding a bolt and each releasably held on the back of a hand, the devices being ready for seriatim reception of a finger, for use in performing a repetitive operation.

FIG. 5 also shows an extended index finger 46 of another hand 48 approaching and about to enter the extreme righthand device 10'.

Figure 6:
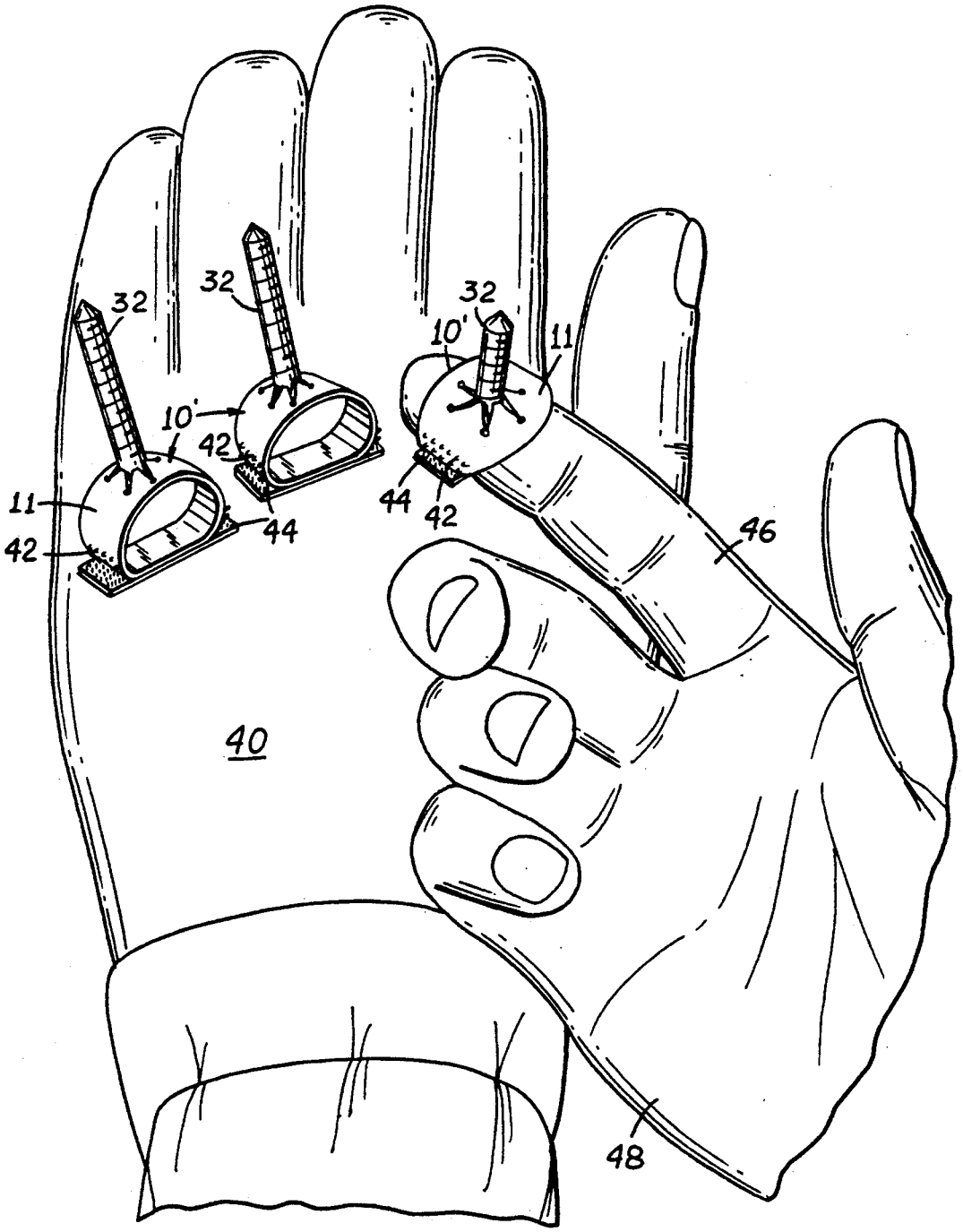
FIG. 6 is a view similar to FIG. 5 showing an elongated member in the form of ah extended index finger having entered one of the devices of FIG. 5.
Figure 7:
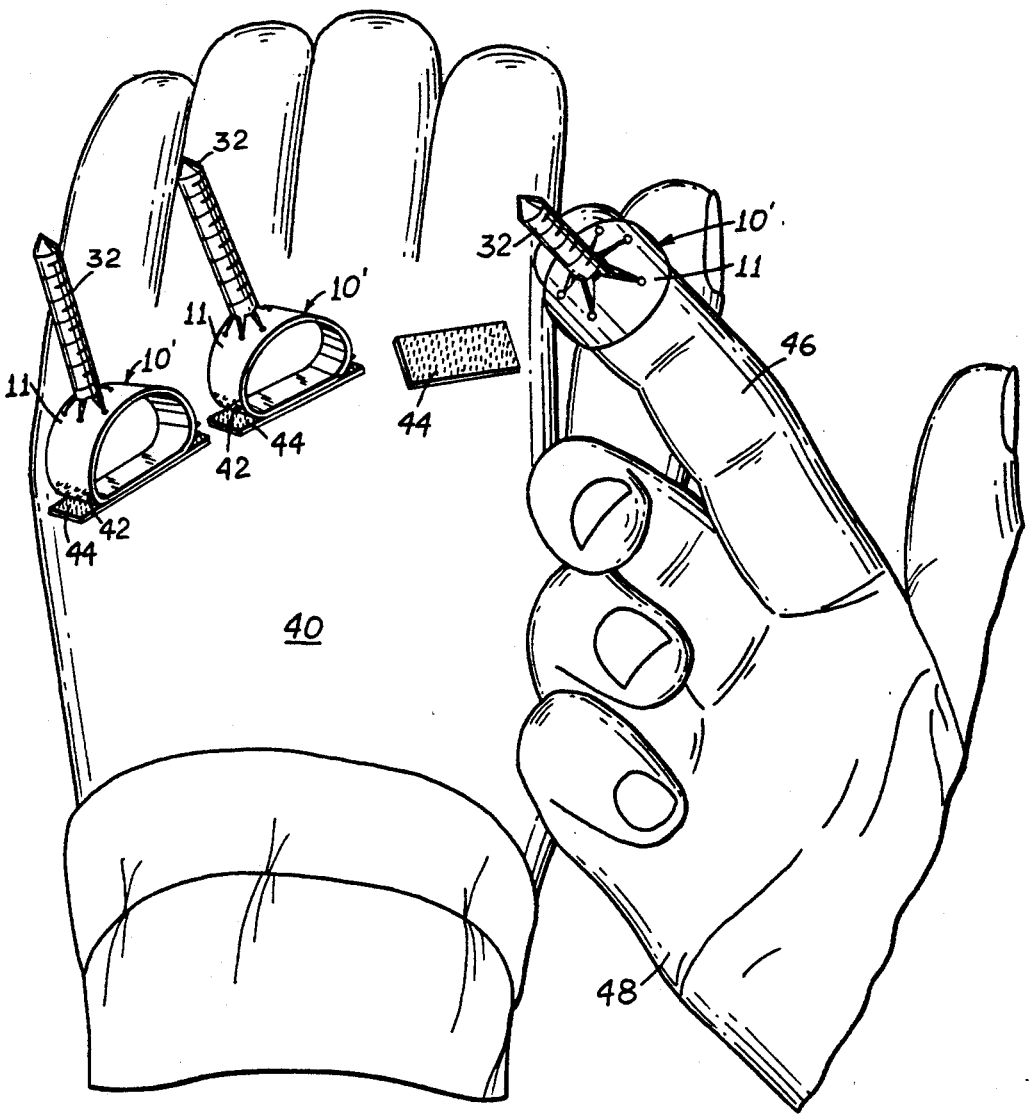
FIG. 7 is a view similar to FIG. 6 but showing the index finger of FIG. 6 having removed the device from the back of the hand.

FIG. 6 is like FIG. 5 but FIG. 6 shows index finger 46 having entered the extreme righthand device 10' of FIG. 5, while FIG. 7 is like FIG. 6 but FIG. 7 shows finger 46 having been moved away from hand 40, taking the extreme righthand device 10' and its bolt 32 with finger 46, after breaking the hook and loop connection of elements 42 and 44, thus holding bolt 32 in readiness for the performance of an operation utilizing same.

The operation can then be readily repeated utilizing the other devices 10' with bolts 32 assembled therewith.

It will be seen that the invention achieves the stated objects and advantages among others.

The disclosed details are exemplary only and are not to be taken as limitations on the invention except as those details are included in the appended claims.

What is claimed is:

1. An improved finger mountable device for temporarily holding an object while an operation is performed utilizing said object, said improved device comprising a tubular elastomeric body, said tubular elastomeric body having a wall, a first open end for receiving said finger and a second open end for passing a finger tip therethrough, a hole through said elastomeric wall, a plurality of slits radiating outwardly from said hole to form slaps circumferentially around said hole, said flaps elastically dilating to accept said object being placed therethrough, so that at least a portion of said object to be temporarily held is placed between said finger and said hole and flaps whereby said object will be elastically held in position by said flaps.

2. A holding device according to claim 1 in which said first open end presents a larger opening than said second open end, said second open end opening being restricted so as to permit only the tip of a finger to pass therethrough, said restricted opening acting to position said device so that said hole and flaps thereto are located on the inner fleshy part of the finger between the first joint of said finger and said finger tip.

3. A holding device according to claim 1 wherein said tubular elastomeric body is manufactured from the group of cured elastomers consisting of natural rubber, polychloroprene, polyisoprene, silicone, polyurethanes, polyacrylates, polybutadienes, styrene butadiene, ethylene/propylene co and ter polymers and acrylonitrile rubbers.

4. A holding device according to claim 1 wherein said tubular elastic body is manufactured from the group of thermoplastic elastomers consisting of styrene butadine or styrene isoprene block copolymers, polyether/-polyester copolymers, polyurethane polymers, arcylic modified polyvinyl chloride and compounded polyvinylchoride.

5. A holding device according to claim 1 wherein said slits extending circumferentially around said hole and radiating from the center of said hole are spaced 60 degrees apart forming six elastically flexible flaps.

* * * * *